US007618357B2

(12) United States Patent
Dalebout et al.

(10) Patent No.: US 7,618,357 B2
(45) Date of Patent: Nov. 17, 2009

(54) FOLDABLE LOW-PROFILE ABDOMINAL EXERCISE MACHINE

(75) Inventors: William T. Dalebout, North Logan, UT (US); Rodney L. Hammer, Lewiston, UT (US); Jared Robert Willardson, Smithfield, UT (US)

(73) Assignee: Icon IP, Inc., Logan, UT (US)

( * ) Notice: Subject to any disclaimer, the term of this patent is extended or adjusted under 35 U.S.C. 154(b) by 0 days.

(21) Appl. No.: 11/532,030

(22) Filed: Sep. 14, 2006

(65) Prior Publication Data

US 2007/0149373 A1 Jun. 28, 2007

Related U.S. Application Data

(63) Continuation-in-part of application No. 11/531,999, filed on Sep. 14, 2006.

(60) Provisional application No. 60/737,437, filed on Nov. 16, 2005.

(51) Int. Cl.
*A63B 26/00* (2006.01)

(52) U.S. Cl. ..... 482/142; 482/148

(58) Field of Classification Search ..... 482/142, 482/121–130, 148
See application file for complete search history.

(56) References Cited

U.S. PATENT DOCUMENTS

| | | | | |
|---|---|---|---|---|
| 2,381,149 | A * | 8/1945 | Wenneborg | 297/23 |
| 3,491,998 | A | 1/1970 | Lyon | |
| 3,589,715 | A | 6/1971 | Mark et al. | |
| D224,422 | S | 7/1972 | Beach | |
| 3,767,190 | A | 10/1973 | Biggerstaff | |
| 4,517,966 | A | 5/1985 | Von Othegraven | |
| 4,533,174 | A * | 8/1985 | Fleishman | 297/16.1 |
| 5,154,685 | A | 10/1992 | Chen | |
| 5,681,250 | A | 10/1997 | Hoover et al. | |
| 5,690,387 | A * | 11/1997 | Sarti | 297/397 |
| 5,902,220 | A | 5/1999 | Lin | |
| 6,022,303 | A | 2/2000 | Abdo | |
| D432,600 | S | 10/2000 | Szabo et al. | |
| 6,248,047 | B1 | 6/2001 | Abdo | |
| 6,394,938 | B1 * | 5/2002 | Tornabene | 482/142 |
| 6,602,171 | B1 * | 8/2003 | Tsen et al. | 482/140 |
| 2003/0050156 | A1 * | 3/2003 | Tornabene | 482/123 |

* cited by examiner

*Primary Examiner*—Lori Amerson
(74) *Attorney, Agent, or Firm*—Madson IP, P.C.

(57) ABSTRACT

An exercise apparatus which may be moveable between a storage mode and an exercise mode. The exercise apparatus may used on a base surface by a user. The exercise apparatus may include a frame for supporting a seat above the base surface. The frame may include a front leg. The frame may include an engaging member that may be pivotally connected to the front leg comprising an engaging portion. The frame may include a rear leg comprising a receiving portion disposed to receive the engaging portion. The exercise apparatus may include a moveable backrest. The moveable backrest may include a resilient spine member. The moveable backrest may include a first end connected to the frame. The moveable backrest may include a second end that is freely moveable. The backrest may be disposed to provide support to the user's back during movement of the backrest.

29 Claims, 4 Drawing Sheets

FOLDABLE LOW-PROFILE ABDOMINAL EXERCISE MACHINE

RELATED APPLICATIONS

This application is related to and claims priority from Provisional U.S. Patent Application Ser. No. 60/737,437 filed Nov. 16, 2005, for an Adjustable Abdominal Exercise Machine, with inventor Rodney Hammer and Nonprovisional U.S. patent application Ser. No. 11/531,999 filed Sep. 14, 2006, for an Adjustable Abdominal Exercise Machine, with inventor Rodney L. Hammer which are incorporated herein by reference.

TECHNICAL FIELD

The present invention relates generally to exercise equipment and exercise-related technology. More specifically, the present invention relates to a foldable low-profile abdominal exercise machine.

BACKGROUND OF THE INVENTION

This invention relates generally to exercise machines for exercising a user's abdominal and back muscles. Exercise machines generally provide resistance to the movement of a user in order to strengthen muscles of the user's body. However, conventional techniques, such as sit-ups, crunches, or roman chair hyperextension exercises, use the body's own weight to exercise the abdominal and back muscles of the user. Consequently, the conventional techniques fail to provide support and controlled resistance to the movements of a user, which can be particularly problematic for out-of-shape or obese users. Specifically, conventional techniques lack ways to control the resistance and motion of the user to prevent injury from an uncontrolled movement or from overloaded and strained muscles.

Of the available exercise machines that may be used to exercise and strengthen a user's abdominal and back muscles by providing resistance to the user's movements, many only permit certain portions of the abdominal and back muscles to be exercised, which leaves other portions unexercised and typically uneven in strength. This often leads to injury. Furthermore, many of these machines do not support the user's back during the exercise, which may lead to hyperextension injuries. These exercise machines also may not be capable of adjusting the resistance to a user's movements or adjusting the position of the user to provide more difficult exercise routines. Additionally, many currently available exercise machines take up large amounts of usable space when not in use, which prevents them from being conveniently located in the user's residence.

Accordingly, a need exists for an exercise machine that permits the user to adjust for more or less difficulty during an exercise routine. A need exists for an exercise machine that supports the back to prevent injury and uncontrolled movements. Additionally, a need exists for an exercise machine that does not occupy an excessive amount of room when it is not in use and that permits easy and convenient storage. Further, a need exists for a foldable exercise machine that can be shipped fully-assembled in low-profile packaging to optimize shipping capacities and reduce shipping costs.

BRIEF SUMMARY OF THE INVENTION

The apparatus and system of the present invention has been developed in response to the present state of the art, and in particular, in response to the problems and needs in the art that have not been fully solved by currently available exercise machines. Thus, the present invention provides an exercise machine that supports and provides resistance to the movements of a user while performing abdominal, oblique, and back exercises.

An exercise apparatus is disclosed. The exercise apparatus is moveable between a storage mode and an exercise mode. The exercise apparatus is for use on a base surface by a user. The exercise apparatus includes a frame for supporting a seat above the base surface. The frame includes a front leg. The frame includes an engaging member pivotally connected to the front leg comprising an engaging portion. The frame includes a rear leg. The rear leg includes a receiving portion disposed to receive the engaging portion. The exercise apparatus includes a moveable backrest. The moveable backrest includes a resilient spine member. The moveable backrest includes a first end connected to the frame. The moveable backrest includes a second end that is freely moveable. The backrest is disposed to provide support to the user's back during movement of the backrest. In other embodiments, the moveable backrest is disposed to provide support to the user's back and neck during movement of the backrest.

In some embodiments, the exercise apparatus includes a first substantially elongate member and a second substantially elongate member. The first substantially elongate member includes a front leg and a resilient spine member. The second substantially elongate member includes a rear leg and a seat. The first substantially elongate member and the second substantially elongate member are connected at a pivot point. The first substantially elongate member and the second substantially elongate member are connected such that they can rotate relative to each other to become substantially coplanar when in the storage or shipping mode.

In some embodiments, the rear leg is pivotally attached to the front leg such that the rear leg extends from the front leg at an angle. In further embodiments, the frame includes a rear leg that is pivotally attached to the front leg by a pin joint such that the rear leg extends from the front leg at an angle in the range of about 100 degrees to about 110 degrees when the exercise apparatus is positioned for use in the exercise mode.

In some embodiments, the moveable backrest includes at least one elongate flexible member. In further embodiments, the elongate flexible member(s) include(s) flexible material to provide resistance to the movement of the user. In still further embodiments, the moveable backrest includes at least one pad capturing the resilient spine member. In other embodiments, the pad(s) capture(s) the resilient spine member and the elongate flexible member.

In some embodiments, one of the pads is attached to the frame. In further embodiments, the exercise apparatus includes a low profile handle that is attached to the second end of the backrest.

In some embodiments, the front leg and the rear leg are disposed substantially coplanar when the exercise apparatus is in the storage or shipping mode. In further embodiments, the exercise apparatus is movable from the storage mode to the exercise mode by applying a single force. In some embodiments, the single force used to move the exercise apparatus from the storage mode to the exercise mode moves the front leg and rear leg from a substantially coplanar position to a substantially non-coplanar position.

In some embodiments, the exercise apparatus is movable from the exercise mode to the storage or shipping mode in two steps. In further embodiments, the two motions used to change the exercise apparatus from the exercise mode to the storage mode include disengaging an engaging member from a receiving portion of the rear leg and moving the front leg and rear leg to a substantially coplanar position.

In some embodiments, in the storage mode, the exercise apparatus is low profile and compact, such that the exercise apparatus comprises a height of less than about four inches, a width of about seventeen and a half inches, and a length of about forty five and a half inches. In further embodiments, the exercise apparatus, when in storage or shipping mode, is fully assembled. In still further embodiments, the exercise apparatus is suspended from a front or a back foot while in storage mode such that the exercise apparatus lies flat against a wall or other surface.

In some embodiments, the second end of the backrest has a first motion in one of the following directions: torsional, forward, backward, or laterally with respect to the first end of the backrest if acted upon by one of the following: a threshold torsional force, a threshold forward force, a threshold backward force, or a threshold lateral force. In further embodiments, the second end of the backrest has a second motion in one of the following directions: torsional, forward, backward, or laterally with respect to the first end of the backrest if acted upon by one of the following: a threshold torsional force, a threshold forward force, a threshold backward force, or a threshold lateral force. In still further embodiments, the first motion and the second motion of the second end of the backrest are different motions and occur simultaneously.

In some embodiments, at least one pad may capture the resilient spine member. In further embodiments, a first flexible member is disposed adjacent to the resilient spine member and captured by the backrest such that the first flexible member provides additional resistance to the user's movements. In still further embodiments, the exercise apparatus includes a low profile handle attached to the backrest that can be grasped by the user during exercising.

These and other features of the present invention will become more fully apparent from the following description and appended claims, or may be learned by the practice of the invention as set forth hereinafter.

BRIEF DESCRIPTION OF THE SEVERAL VIEWS OF THE DRAWINGS

In order that the manner in which the above-recited and other features and advantages of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the exercise machine of the present invention, as represented in FIGS. 1 through 5, is not intended to limit the scope of the invention, as claimed, but is merely representative of presently preferred embodiments of the invention.

The phrases "connected to," "coupled to," and "in communication with" refer to any form of interaction, though not necessarily direct interaction, between two or more entities, including mechanical, electrical, magnetic, electromagnetic, and thermal interaction. For example, a part or piece may intervene between two pieces that are "connected to," "coupled to," and "in communication with" each other. The phrase "attached to" refers to a form of mechanical coupling that restricts relative translation or rotation between the attached objects. The phrases "pivotally attached to" and "slidably attached to" refer to forms of mechanical coupling that permit relative rotation or relative translation, respectively, while restricting other relative motion. The phrase "directly attached to" refers to a form of attachment by which the attached items are either in direct contact, or are only separated by a single fastener, adhesive, or other attachment mechanism. The term "abutting" refers to items that are in direct physical contact with each other, although the items may not be attached together.

Figure 1:
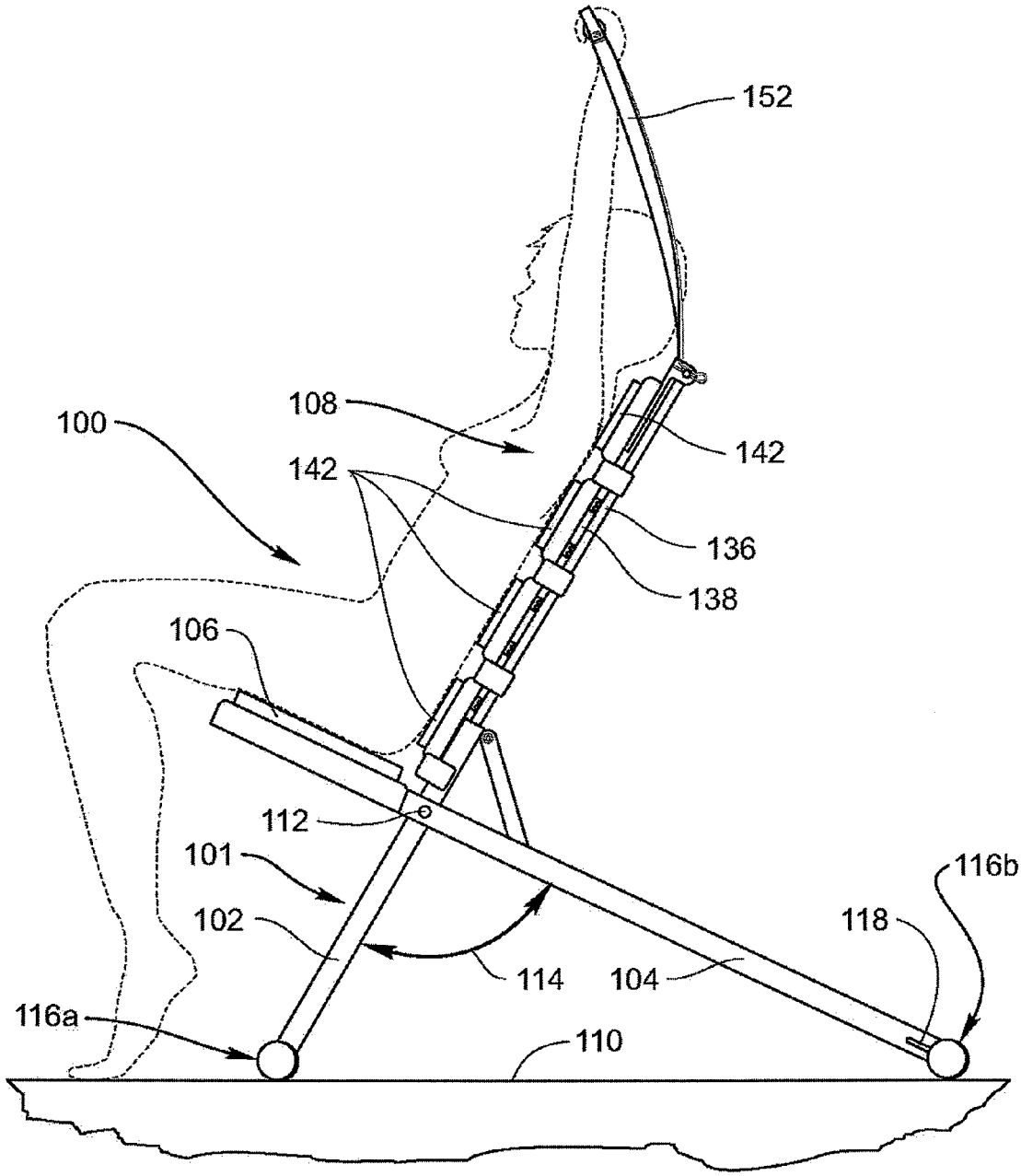
FIG. 1 is a side elevation view of an embodiment of an exercise machine showing a user in phantom lines.

FIG. 1 is a side elevation view of an embodiment of an exercise machine 100 showing a user in phantom lines. In the illustrated embodiment, the exercise apparatus 100 has a frame 101 that includes a front leg 102, a rear leg 104, a seat 106, and a moveable backrest 108. The seat 106 and moveable backrest 108 are positioned above a base surface 110, such as the floor of a building. The front leg 102 may be pivotally attached to the rear leg 104 by a pin 112. Of course, the front leg 102 and the rear leg 104 may be pivotally attached in other ways.

The exercise machine 100 may be moveable between an exercise mode and a storage or shipping mode. FIG. 1 illustrates the exercise machine 100 in an exercise mode. In exercise mode, the front leg 102 may be disposed substantially noncoplanar to the rear leg 104. The front leg 102 may be disposed substantially noncoplanar to the rear leg 104 because the angle 114 between a first plane (not illustrated) defined by the front leg 102 and a second plane (not illustrated) defined by the rear leg 104 is less than approximately one hundred and eighty (180) degrees. In storage or shipping mode, the front leg 102 may be disposed substantially coplanar to the rear leg 104. The front leg 102 may be disposed substantially coplanar from the rear leg 104 because the angle 114 between a first plane (not illustrated) of the front leg 102 and a second plane (not illustrated) of the rear leg 104 is about one hundred and eighty (180) degrees.

In the exercise mode, the front leg 102 may extend from the rear leg 104 at angle 114. The angle 114 may range from about 90 degrees to about 130 degrees. However, the exercise apparatus 100 may still operate at angles 114 outside this stated range. In the present embodiment, the front leg 102 extends from the rear leg 104 at an angle 114 in the range of about 100 degrees to about 110 degrees.

As shown, the front leg 102 and the rear leg 104 may each have feet 116*a*, 116*b*, respectively. The feet 116*a*, 116*b* may extend on both sides of the exercise apparatus 100 to stabilize and provide a sturdy base for the exercise apparatus 100. The rear foot 116*b*, in the present embodiment, is attached to the rear leg 104 and includes attachment rings 118 for connecting resistance bands (shown in FIG. 2) to the exercise apparatus 100. The attachment rings 118 also may be connected to other parts of the exercise apparatus 100, such as the front foot 116*a*. In the present embodiment, the attachment rings are welded to the rear foot 116*b*. In other embodiments, the attachment rings 118 may be integrally formed with the feet 116*a*, 116*b* or may be attached using other techniques.

The resistance bands may be used with the exercise apparatus 100 to strengthen the arms, chest, and shoulders. For example, the resistance bands may permit a user to perform exercises such as Bench Press, Military Press, Chest Fly, Bicep Curl, Lateral Fly, Front Raise, Shoulder Press, and other exercises.

In the present embodiment, the seat 106 is connected to and extends from the rear leg 104. In other embodiments, the seat 106 may be connected to another portion of the exercise apparatus 100, such as the front leg 102, the backrest 108, etc. The seat may be padded for added comfort and may include a non-slip material to prevent a user from slipping off of the exercise apparatus 100 while exercising.

The backrest 108 may be attached to the front leg 102. The backrest 108 may include an engaging member 120. In the present embodiment, the engaging member 120 may be attached to the front leg 102 of the exercise apparatus 100. The engaging member 120 may engage the rear leg 104 to support the backrest 108 in exercise mode. The engaging member 120 may engage the rear leg 104 to prevent the exercise apparatus from moving from the exercise mode to the storage or shipping mode. The relationship between the engaging member 120 and the rear leg 104 will be discussed in more detail in connection with the discussion of FIG. 3.

The exercise apparatus 100 may include a resilient spine member 138. The resilient spine member 138 supports the user's back and will be discussed in more detail in FIG. 2. The backrest 108 may also include flexible members 136. The flexible members 136 and the resilient spine member 138 may be captured by a series of pads 142.

Low profile handles 152 may be connected to the backrest 108 to permit a user to comfortably grip the low profile handles 152 to exercise their abdominal and back muscles.

Figure 2:
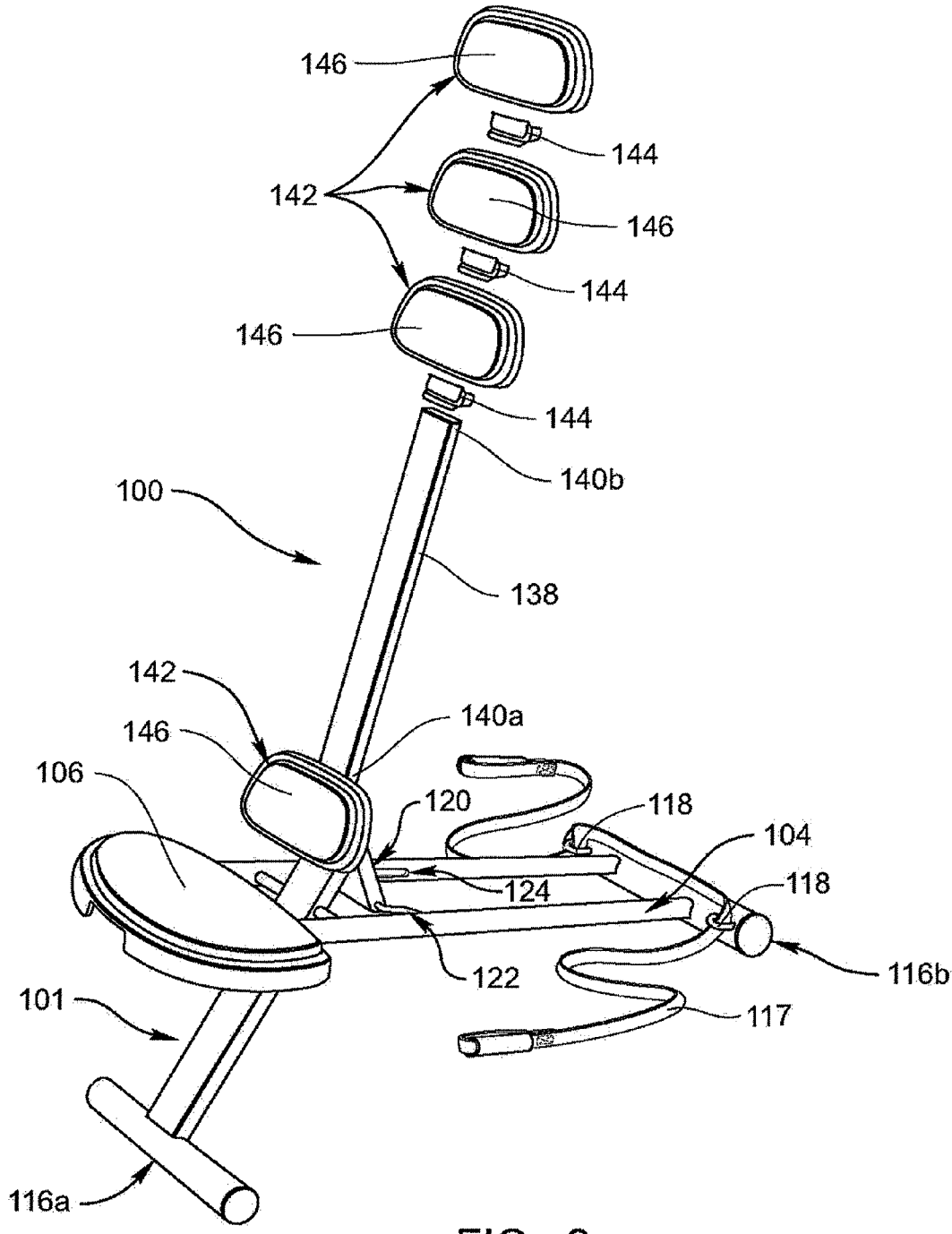
FIG. 2 is a partially exploded perspective view of an embodiment of the exercise machine shown in FIG. 1.

FIG. 2 is a partially exploded perspective view of an embodiment of the exercise machine 100 shown in FIG. 1. The assembly of the series of pads 142 over the resilient spine member 138, in the embodiment of the exercise machine 100 of FIG. 1, is generally illustrated.

The resilient spine member 138 may include a first end 140*a* and a second end 140*b*. The first end 140*a* may be connected to the frame 101 by fasteners, welding, or any other suitable connection method. In the present embodiment, the first end 140*a* is connected using fasteners (not illustrated) to the front leg 102. In some embodiments, the first end 140*a* may be indirectly connected to the frame 101 through an intervening piece or may use some other type of direct or indirect connection, rather than, as in the present embodiment, directly connecting to the front leg 102. The second end 140*b* of the resilient spine member 138 may be freely movable against its inherent resistance in any direction except toward the first end 140*a*.

The engaging member 120 may include an engaging portion 122. In the present embodiment, the engaging portion 122 is welded to the engaging member 120. In other embodiments, the engaging portion 122 and the engaging member 120 may be integrally formed, may be fastened together, or may be connected using any other suitable connecting method. The engaging portion 122 may engage a receiving portion 124 of rear leg 104.

The series of pads 142 may be made of plastic, composite material, metal, foamed plastic, or any other suitable material. The series of pads 142 may be connected to or disposed over the resilient spine member 138. In the present embodiment, only the bottommost and topmost pads 142 are connected to the resilient spine member 138, while the remaining pads 142 are slidably attached to the resilient spine member 138. For example, one of the pads 142 may also be attached to the front leg 102. Attaching one of the pads 142 to the front leg 102 may also help to isolate certain muscle groups during an exercise routine. The pad 142 may be attached to the front leg 102 by fasteners (not illustrated).

Spacers 144 may be included with the series of pads 142. The spacers 144 may be used to attach the pads 142 to the resilient spine member 138 and to separate the series of pads 142. The spacers 144, in the present embodiment, are connected to a structural portion (not illustrated) of the pads 142. Cushioned portions 146 may be disposed to provide a comfortable surface to engage a user's back.

The seat 106 may be connected to the frame 101. In the present embodiment, the seat 106 is bolted to the rear leg 104 of the frame 101. The seat 106 may be integrally formed with, welded to, or otherwise connected to the frame 101 using any suitable connecting method.

FIG. 2 also illustrates the resistance bands 117 inserted through the attachment rings 118. The resistance bands 117 may be connected to the frame 101 using any method. The resistance bands 117 may be made of surgical tubing, elastic bands, springs, or other materials that may provide resistance to a user's movement. The resistance bands 117 may be threaded as shown in FIG. 2 or each band 117 may be separately attached to an attachment ring 118. Multiple resistance bands 117 may also be used to provide added resistance.

Figures 3, 3A:
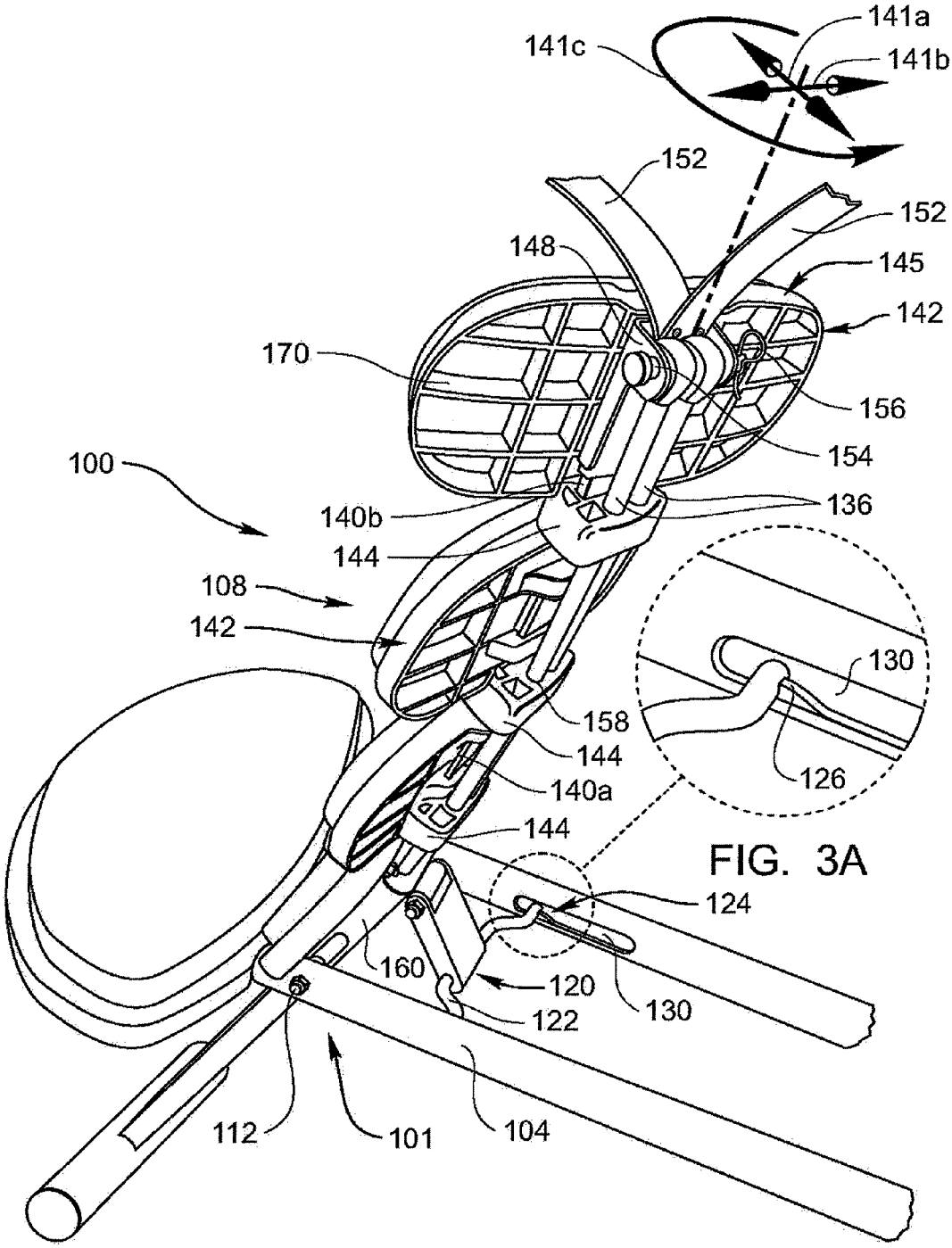
FIG. 3 is a top perspective view of the exercise machine of FIG. 1.
FIG. 3A is a top perspective enlarged view of a cutaway of the exercise machine of FIG. 3.

FIG. 3 is a top perspective view of the exercise machine 100 of FIG. 1. In the illustrated embodiment, the backrest 108 is disposed in exercise mode, such that the engaging portion 122 of the engaging member 120 engages a receiving portion 124 of the rear leg 104.

FIG. 3 generally illustrates forces 141*a*, 141*b*, 141*c* of various types that the user may apply to the backrest 108. The resilient spine member 138 may provide resistance to these forces (i.e., forward and backward forces 141*a*, side to side forces 141*b*, and torsional forces 141*c*) applied by the user in order to strengthen the user's abdominal, lower back, and upper back muscles.

To adjust the resistance of the forces 141*a*, 141*b*, 141*c* created by the user's movement of the backrest 108, one or more additional flexible members 136 may be added or removed from the backrest 108. The flexible members 136 may provide support to the user's back and may provide resistance to forward and backward forces 141*a*, side to side forces 141*b*, and torsional forces 141*c* in order to strengthen the user's the abdominal, lower back, and upper back muscles.

The flexible members 136 may be elongated members made of a resilient material and/or may have a resilient structure. For example, the flexible member 136 may be made of nylon, fiberglass, plastics, metal, and/or composite materials and may be shaped as a rod, beam, leaf spring, or coiled spring. By varying the materials and/or design of the flexible member 136 the backrest 108 may provide different levels of resistance to the movements of a user.

In the present embodiment, the flexible members 136 have generally the same resistance characteristics. For example, the flexible members 136 may include a circular profile in order to provide relatively uniform resistance to any direction a force may be applied to the backrest 108. Of course, other profiles may be used in order to increase resistance in desired directions. Alternatively, the flexible members 136 that are used may have different resistance characteristics.

The flexible members 136 may extend through loops 158 of the spacers 144 of the pads 142 and may be attached to an attachment structure 148 by the pin 154 and secured by the cotter pin 156. The flexible members 136 may be secured to the backrest 108 in any suitable fashion and may or may not be removable. In the present embodiment, the flexible members 136 may extend into a pocket 160 of the front leg 102. Specifically, the proximal end (not illustrated) of the flexible member 136 may be secured within the pocket 160 by fasteners (not illustrated).

Though, in the present embodiment, two flexible members 136 are used, in other embodiments, only one flexible member 136 may be used. In further embodiments, more than two flexible members 136 may be used. In many embodiments, the user may select the number and resistance characteristics of the flexible members 136 used to customize the user's exercise routine.

FIG. 3 also generally illustrates the structure of the pads 142 in more detail. For example, the pads 142 may include structural portions 145. The structural portions 145 may be disposed to permit the backrest 108 to flex while providing strength to the pads 142. For example, the structural portions 145 of the pads 142 may include stiffening structures 170 that help the backrest 108 support a user's back. In the present embodiment, the stiffening structures 170 are webbing molded into the structural portions 145 of the pads 142.

The series of pads 142 may include the attachment structure 148 for attaching the pads 142 to the first end 140*a* of the resilient spine member 138 and to the low profile handles 152 of the backrest 108. The structural portions 145 may be molded over the attachment structure 148 to securely integrate the attachment structure 148 with the pads 142. The structural portions 145 may or may not be connected to the spacers 144.

The low profile handles 152 may be connected to the attachment structure 148 by fasteners, may be welded into position, or may be connected using any other suitable connection method. In the present embodiment, the low profile handles 152 are connected to the attachment structure 148 using fasteners (not illustrated).

FIG. 3A is a cutaway top perspective sectional view of the exercise machine 100 of FIG. 1. FIG. 3A illustrates the engaging portion 122 of the engaging member 120 and the receiving portion 124 of the rear leg 104 in exercise mode. The engaging portion 122 of the engaging member 120 may engage the receiving portion 124, such that the backrest 108 is supported.

In the present embodiment, the engaging portion 122 comprises an offset cylindrical protrusion. The receiving portion 124 may be disposed to engage the engaging portion 122 of the engaging member 120, such that, when engaged, the engaging member 120 may support the backrest 108 of the exercise apparatus 100. The receiving portion 124, in the present embodiment, may include a slot 130 and a stop member 126. The slot 130 may be elongated such that the length of the slot 130 is longer than the height of the slot 130. The height of the slot 130 may be more than twice the diameter of the cylindrical protrusion of the engaging portion 122.

In other embodiments, the receiving portion 124 may include multiple stop members 126. With multiple stop members 126 positioned along the slot 130, the angle of the backrest 108 to the base surface 110 may be adjustable. The stop member 126 may have a rounded surface where the engaging portion 122 of the engaging member 120 contacts the stop member 126. The stop member 126 may have a height that is approximately the same as the diameter of the offset cylindrical protrusion of the present embodiment. In further embodiments, the receiving portion 124 may include other shapes that may allow the engaging portion 122 of the engaging member 120 to engage and disengage the receiving portion 124. In still further embodiments, the engaging portion 122 may include other configurations to engage and disengage the receiving portion 124.

Figure 4:
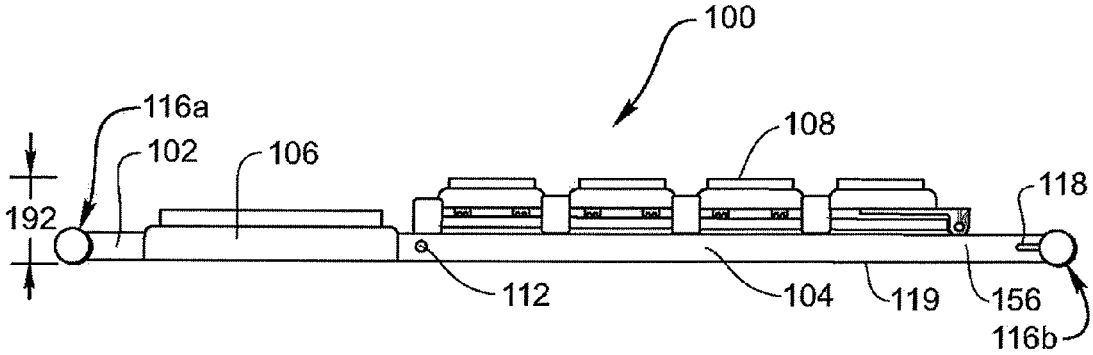
FIG. 4 is a side elevation view of the exercise machine illustrating a non-use, storage or shipping mode for the exercise machine.

FIG. 4 is a side elevation view of the exercise machine 100 illustrating a non-use, storage or shipping mode of the exercise machine 100. As shown, the front leg 102 and the rear leg 104 are disposed such that they are substantially coplanar. In the present embodiment, the seat 106 is shaped such that the front leg 102 is captured by the seat 106 in storage or shipping mode. For example, portions of the seat 106 may be formed so that the front leg 102 nests into the contour of the seat 106 in storage or shipping mode. In another example, the backrest 108 is shaped such that the backrest 108 abuts the rear leg 104 is storage or shipping mode.

As shown, the front leg 102 and the rear leg 104 are generally straight beams in order to minimize the profile of the exercise apparatus 100 in storage or shipping mode. Of course, the front leg 102 and the rear leg 104 may also be curved to be more aesthetically pleasing, though the exercise apparatus 100 may require more vertical space when in storage or shipping mode.

The exercise apparatus 100, as shown in FIG. 4, is a low profile exercise apparatus 100. The exercise apparatus 100 may be low profile because the overall height 192 of the exercise apparatus 100 in storage or shipping mode may be less than, for example, eight inches. The overall height 192 of the present embodiment is about four inches.

Figure 5:
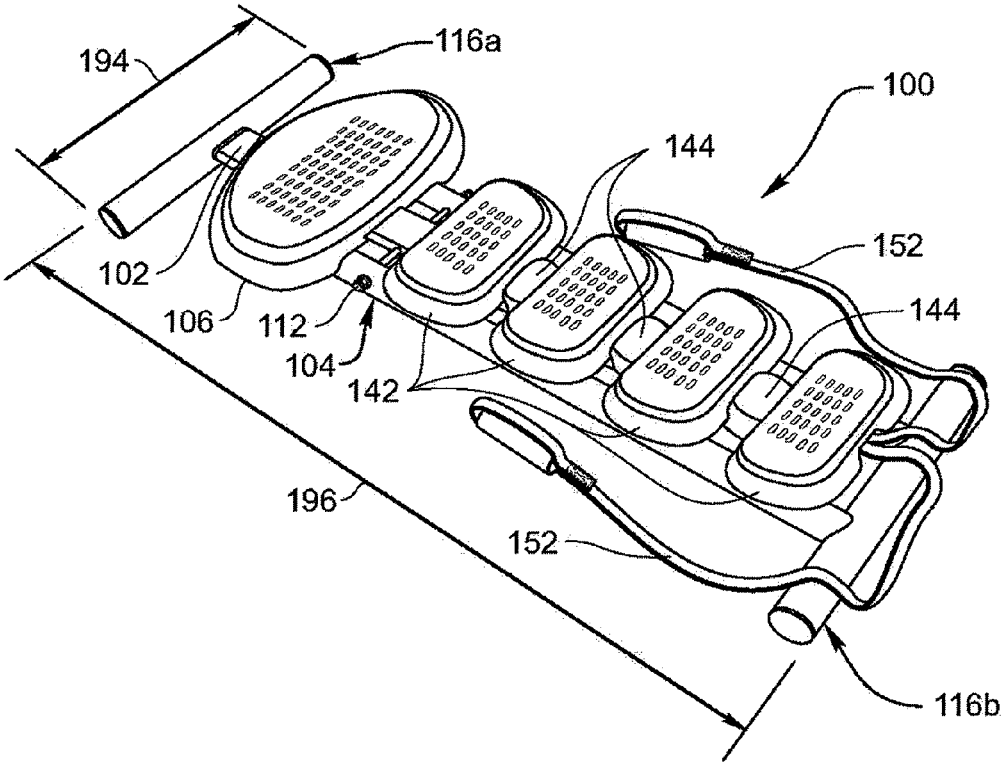
FIG. 5 is a perspective view of the exercise machine illustrating a non-use, storage or shipping mode for the exercise machine.

FIG. 5 is a perspective view of the exercise machine 100 illustrating a non-use, storage or shipping mode for the exercise machine. The storage or shipping mode may permit the exercise apparatus 100 to be easily stored in a closet or under or behind furniture, such as a bed, couch, or dresser when the exercise apparatus 100 is not in use. The storage or shipping mode may be especially advantageous in small apartments and condos where space is limited. In the present embodiment, the exercise apparatus 100 may be hung from a wall using either the front foot 116*a* or the rear foot 116*b*, while lying flat against the wall, much like an ironing board can be suspended to lie flat against a wall.

FIG. 5 illustrates that the exercise apparatus 100 may be shipped in a fully assembled state. For example, the resilient spine member 138 (shown in FIG. 2) may be connected to the front leg 102, the seat 106 may be connected to the rear leg 104, the pads 142 and spacers 144 may capture the resilient spine member 138, the low profile handles 152 may be attached to the attachment structure 148 (shown in FIG. 3), the front leg 102 and the rear leg 104 may be pivotally connected by bolt 112, and the engaging member 120 (shown in FIG. 3) may be pivotally connected to the front leg 102.

A principal advantage of the low-profile exercise apparatus 100 is that it may be fully assembled before shipping and can be shipped in its low-profile storage or shipping mode. The ability to ship the exercise apparatus 100 fully assembled provides the advantage that the end user is not required to assemble any parts, but rather may quickly, in a single motion, move the exercise apparatus 100 from the storage mode to the exercise mode ready for use.

The exercise apparatus 100, as shown in FIG. 5, is a compact, low-profile exercise apparatus 100. The exercise apparatus 100 has overall width 194 that may be less than, for example, seventeen and a half inches. The exercise apparatus 100 has an overall length 196 that may be less than, for example, forty five and a half inches. Consequently, with the low-profile overall height 192, which is less than eight inches, such as shown at about four inches, the entire exercise apparatus 100 may be enclosed in a box for shipping that has a total volume of less than six thousand four hundred cubic inches. In another embodiment, the entire exercise apparatus 100 may be enclosed in a box for shipping that has a total volume of less than three thousand two hundred cubic inches. By having a shipping box of such small dimensions, many more boxes may be shipped in a single trailer, container, or boxcar. Hence, shipping costs may be dramatically reduced. Further, shelve space or floor space required to display the exercise apparatus for sale may also be minimized.

The low profile handles 152 of the exercise apparatus 100 do not increase the overall height or width of the exercise apparatus 100 because they may be made of a flexible material that can be tucked into the box for shipping. The low profile handles 152 enable the user to grasp the handles 152 while exercising to balance the user and, depending on the exercise, either assist or not assist (cheat) during the exercise. For example, in the present embodiment, the handles 152 may include foam handles connected to the backrest 108 made of cloth webbing, such that the handles 152 may be stored within a shipping box in any open space left in the box after packing. Other low profile handles 152 may be used. For example, the handles 152 may be made of flexible plastic that may extend from the backrest 108 such that they do not exceed the width of the feet 116*a*, 116*b*, so that the exercise apparatus 100 may remain low profile and compact.

Furthermore, upon receiving the exercise apparatus 100, the user may move the exercise apparatus 100 from the shipping mode to the exercise mode using one force. For example, the user may simply step on the foot 116*b* of the rear leg 104 and pull up on the topmost pad 142 until the engaging portion 122 of the engaging member 120 abuts the opposite end of the slot 130, then by releasing the topmost pad 142 and the engaging portion 122 of the engaging member 120 engages the stop member 126 such that the backrest 108 may be supported against the back leg 104 in the exercise mode.

The exercise apparatus 100 may be moved from exercise mode to the storage or shipping mode in two steps. For example, the user may disengage the engaging member 120 from the receiving portion 124 and then fold or flatten the exercise apparatus 100 (i.e., push the topmost pad 142 toward the rear foot 116*b* of the rear leg 104). The ability to move the exercise apparatus 100 from the exercise mode to the storage or shipping mode in two steps may provide the advantage of being able to quickly store the exercise apparatus 100 under a bed, in a closet, on a wall, etc.

In summary, an exercise machine for strengthening the abdominal and back muscles of a user includes a backrest for supporting a user's back to prevent injury. The backrest includes flexible members for adjusting the resistance that the backrest provides to the user's movements. The backrest is also adjustable in position to control the difficulty of an exercise routine as well as the stress and strain that a user's back and abdominal muscles are subjected to during an exercise routine. The exercise also includes a non-use, storage or shipping mode that facilitates storage and makes the exercise machine more accessible because it may be kept at home or in an office where the user is most likely to use the exercise machine.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

The invention claimed is:

1. An exercise apparatus moveable between a storage mode and an exercise mode for use on a base surface by a user comprising:

a frame for supporting a seat above the base surface comprising:

a front leg;

an engaging member pivotally connected to the frame comprising an engaging portion; and a rear leg comprising a receiving portion disposed to receive the engaging portion;

a moveable backrest comprising:

a resilient spine member with a first end connected to the frame; and a second end that is freely moveable; and a first flexible member disposed adjacent to the resilient spine member and captured by the backrest such that the first flexible member provides resistance to the user's movements, wherein said backrest is disposed to provide support to the user's back during movement of the backrest, and wherein the exercise apparatus can be stored substantially vertically and flat against a wall by suspending the exercise apparatus from a front or a back foot while in storage mode.

2. The exercise apparatus of claim 1, wherein the front leg and the rear leg are disposed substantially coplanar when the exercise apparatus is in the storage mode.

3. The exercise apparatus of claim 1, wherein the exercise apparatus is movable from the storage mode to the exercise mode by applying a single force.

4. The exercise apparatus of claim 3, wherein the single force used to move the exercise apparatus from the storage mode to the exercise mode moves the front leg and rear leg from a substantially coplanar position to a substantially non-coplanar position.

5. The exercise apparatus of claim 1, wherein the exercise apparatus is movable from the exercise mode to the storage mode in two steps.

6. The exercise apparatus of claim 5, wherein the two steps used to change the exercise apparatus from the exercise mode to the storage mode include disengaging the engaging member from the receiving portion of the rear leg and moving the front leg and rear leg to a substantially coplanar position.

7. The exercise apparatus of claim 1, wherein, in the storage mode, the exercise apparatus is low profile and compact, such that the exercise apparatus comprises a height of less than about four inches, a width of about seventeen and a half inches, and a length of about forty five and a half inches.

8. The exercise apparatus of claim 1, wherein, the exercise apparatus is fully assembled in storage mode.

9. The exercise apparatus of claim 1, wherein the second end of the backrest has a first motion in one of the following directions: torsional, forward, backward, or laterally with respect to the first end of the backrest if acted upon by one of the following: a threshold torsional force, a threshold forward force, a threshold backward force, or a threshold lateral force.

10. The exercise apparatus of claim 9, wherein the second end of the backrest has a second motion in one of the following directions: torsional, forward, backward, or laterally with respect to the first end of the backrest if acted upon by one of the following: a threshold torsional force, a threshold forward force, a threshold backward force, or a threshold lateral force.

11. The exercise apparatus of claim 10, wherein the first motion and the second motion of the second end of the backrest are different motions and occur simultaneously.

12. The exercise apparatus of claim 1, further comprising at least one pad that captures the resilient spine member.

13. The exercise apparatus of claim 1, further comprising a second flexible member disposed adjacent to the resilient spine member and captured by the backrest such that the second flexible member provides resistance to the user's movements.

14. The exercise apparatus of claim 1, further comprising a low profile handle attached to the backrest.

15. An exercise apparatus with a storage mode and an exercise mode for use on a base surface by a user comprising:

a frame for supporting a seat above the base surface comprising:

a front leg;

an engaging member pivotally connected to the frame comprising an engaging portion; and a rear leg that is pivotally attached to the front leg such that the rear leg extends from the front leg at an angle comprising a receiving portion disposed to receive the engaging portion;

a moveable backrest comprising:

a resilient spine member with a first end connected to the frame and a second end that is freely moveable;

at least one pad capturing the resilient spine member, wherein one of the at least one pads is attached to the frame; and a first flexible member disposed adjacent to the resilient spine member and captured by the backrest such that the first flexible member provides resistance to the user's movements, wherein said backrest is disposed to provide support to the user's back and neck during movement of the backrest.

16. The exercise apparatus of claim 15, wherein the front leg and the rear leg are disposed substantially coplanar in the storage mode.

17. The exercise apparatus of claim 16, wherein the exercise apparatus is moveable from the storage mode to the exercise mode by applying a single force.

18. The exercise apparatus of claim 17, wherein the single force used to change the exercise apparatus from the storage mode to the exercise mode moves the front leg and rear leg from a substantially coplanar position to a substantially non-coplanar position.

19. The exercise apparatus of claim 18, wherein the exercise apparatus is moveable from the exercise mode to the storage mode in two steps.

20. The exercise apparatus of claim 19, wherein the two steps used to change the exercise apparatus from the exercise mode to the storage mode include disengaging the engaging member from the receiving portion of the rear leg and moving the front leg and rear leg to a substantially coplanar position.

21. The exercise apparatus of claim 20, wherein, in the storage mode, the exercise apparatus is low profile and compact, such that the exercise apparatus comprises a height of less than about four inches, a width of about seventeen and a half inches, and a length of about forty five and a half inches.

22. The exercise apparatus of claim 21, wherein, the exercise apparatus is fully assembled in storage mode.

23. The exercise apparatus of claim 22, wherein the exercise apparatus can be stored substantially vertically and flat against a wall by suspending the exercise apparatus from a front or a back foot while in storage mode.

24. The exercise apparatus of claim 23, wherein the second end of the backrest has a first motion in one of the following directions: torsional, forward, backward, or laterally with respect to the first end of the backrest if acted upon by one of the following: a threshold torsional force, a threshold forward force, a threshold backward force, or a threshold lateral force.

25. The exercise apparatus of claim 24, wherein the second end of the backrest has a second motion in one of the following directions: torsional, forward, backward, or laterally with respect to the first end of the backrest if acted upon by one of the following: a threshold torsional force, a threshold forward force, a threshold backward force, or a threshold lateral force.

26. The exercise apparatus of claim 25, wherein the first motion and the second motion of the second end of the backrest are different motions and occur simultaneously.

27. The exercise apparatus of claim 26, further comprising at least one pad that captures the resilient spine member.

28. The exercise apparatus of claim 27, further comprising a low profile handle attached to the backrest.

29. An exercise apparatus with a storage mode and an exercise mode for use on a base surface by a user comprising:

a frame for supporting a seat above the base surface comprising:

a front leg;

an engaging member pivotally connected to the front leg comprising an engaging portion; and a rear leg that is pivotally attached to the front leg by a pin joint such that the rear leg extends from the front leg at an angle in the range of about 100 degrees to about 110 degrees comprising a receiving portion disposed to receive the engaging portion;

a moveable backrest comprising:

a resilient spine member;

a first end connected to the frame;

a second end that is freely moveable;

at least one elongate flexible member comprising flexible material to provide resistance to the movement of the user; and wherein said backrest is disposed to provide support to the user's back and neck during movement of the backrest;

at least one pad capturing the resilient spine member and the at least one elongate flexible member, wherein one of the at least one pads is attached to the front leg; and a low profile handle that is attached to the second end of the backrest.

* * * * *